US009702085B2

(12) United States Patent
Kosonen et al.

(10) Patent No.: US 9,702,085 B2
(45) Date of Patent: Jul. 11, 2017

(54) METHOD FOR MAKING PAPER PRODUCT AND PAPER PRODUCT

(71) Applicant: UPM-KYMMENE CORPORATION, Helsinki (FI)

(72) Inventors: Mika V. Kosonen, Lappeenranta (FI); Mika Räty, Saimaanharju (FI); Jussi Ventola, Kauniainen (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

(21) Appl. No.: 14/420,091

(22) PCT Filed: Aug. 21, 2013

(86) PCT No.: PCT/FI2013/050814
§ 371 (c)(1),
(2) Date: Feb. 6, 2015

(87) PCT Pub. No.: WO2014/029916
PCT Pub. Date: Feb. 27, 2014

(65) Prior Publication Data

US 2015/0218756 A1 Aug. 6, 2015

(30) Foreign Application Priority Data

Aug. 21, 2012 (FI) ..... 20125867

(51) Int. Cl.
*D21H 11/20* (2006.01)
*D21H 11/18* (2006.01)
(Continued)

(52) U.S. Cl.
CPC ..... *D21H 11/20* (2013.01); *D21H 11/18* (2013.01); *D21H 17/25* (2013.01); *D21H 17/29* (2013.01);
(Continued)

(58) Field of Classification Search
CPC ..... D21H 11/18; D21H 17/67; D21H 17/69; D21H 17/675; D21H 11/20; D21H 17/25;
(Continued)

(56) References Cited

U.S. PATENT DOCUMENTS 4,804,441 A * 2/1989 Lyytinen ..... D21F 1/02 162/212
8,945,345 B2 * 2/2015 Laine ..... D21H 11/18 162/175
(Continued)

FOREIGN PATENT DOCUMENTS

CH EP 2236664 A1 * 10/2010 ..... D21B 1/16
CH WO 2011134939 A1 * 11/2011 ..... D21C 9/007
(Continued)

OTHER PUBLICATIONS

Translation of Dec. 14, 2015 Office Action issued in Finnish Patent Application No. 20125867.
(Continued)

*Primary Examiner* — Jose Fortuna
(74) *Attorney, Agent, or Firm* — Nixon Peabody LLP

(57) ABSTRACT

Paper product is made starting from aqueous furnish containing fibers and filler. Anionically charged nanofibrillar cellulose and cationic strength additive are added to the aqueous furnish, and the furnish is made to a paper product by dewatering the furnish. Filler content of the paper product can be increased above 40 wt-%.

20 Claims, 1 Drawing Sheet

(51) Int. Cl.

| | |
|---|---|
| ***D21H 21/18*** | (2006.01) |
| ***D21H 17/29*** | (2006.01) |
| ***D21H 17/67*** | (2006.01) |
| ***D21H 17/25*** | (2006.01) |
| ***D21H 17/66*** | (2006.01) |
| ***D21H 17/68*** | (2006.01) |

(52) U.S. Cl.
CPC ..... *D21H 17/66* (2013.01); *D21H 17/675* (2013.01); *D21H 17/68* (2013.01); *D21H 21/18* (2013.01)

(58) Field of Classification Search
CPC ..... D21H 21/18; D21H 17/66; D21H 17/29; D21H 17/63; D21H 17/68; D21H 23/04; D21H 17/28; D21H 17/44; D21H 21/10; D21H 23/02; D21H 23/18; Y10T 428/298
See application file for complete search history.

(56) References Cited

U.S. PATENT DOCUMENTS

| | | | | |
|---|---|---|---|---|
| 8,980,058 | B2 * | 3/2015 | Feng | D21H 17/375 162/158 |
| 9,181,653 | B2 * | 11/2015 | Paltakari | D21H 11/18 |
| 2010/0065236 | A1 * | 3/2010 | Henriksson | D21C 9/002 162/174 |
| 2012/0094953 | A1 * | 4/2012 | Gane | D21B 1/16 514/57 |
| 2012/0132380 | A1 * | 5/2012 | Hentze | D21F 11/00 162/141 |
| 2012/0132381 | A1 * | 5/2012 | Hentze | D21F 11/00 162/149 |
| 2012/0132383 | A1 * | 5/2012 | Laine | D21H 11/18 162/175 |
| 2013/0000855 | A1 * | 1/2013 | Nuopponen | D21H 11/18 162/76 |
| 2013/0126112 | A1 * | 5/2013 | Gane | D21C 9/007 162/141 |
| 2014/0154756 | A1 * | 6/2014 | Nelson | C08B 15/08 435/135 |
| 2014/0182797 | A1 * | 7/2014 | Paltakari | D21H 11/18 162/72 |
| 2014/0338849 | A1 * | 11/2014 | Kosonen | C08B 15/04 162/1 |
| 2014/0371172 | A1 * | 12/2014 | Gane | D21B 1/16 514/57 |
| 2015/0101769 | A1 * | 4/2015 | Laine | D21H 11/18 162/9 |
| 2015/0101770 | A1 * | 4/2015 | Laine | D21H 11/18 162/9 |
| 2015/0144279 | A1 * | 5/2015 | Laine | D21H 11/18 162/9 |
| 2015/0184345 | A1 * | 7/2015 | Nelson | D21H 21/32 435/139 |
| 2015/0204017 | A1 * | 7/2015 | Nelson | C08B 15/08 435/99 |
| 2015/0218756 | A1 * | 8/2015 | Kosonen | D21H 11/18 162/141 |
| 2015/0315747 | A1 * | 11/2015 | Heiskanen | D21H 11/18 162/181.2 |
| 2015/0330024 | A1 * | 11/2015 | Gane | D21C 9/007 162/149 |
| 2016/0201265 | A1 * | 7/2016 | Kosonen | D21H 11/18 162/175 |
| 2016/0273165 | A1 * | 9/2016 | Laine | D21H 11/20 |

FOREIGN PATENT DOCUMENTS

| | | | | | |
|---|---|---|---|---|---|
| CN | 102080342 | A | | 6/2011 | |
| EP | 2 157 237 | A1 | | 2/2010 | |
| FI | WO 2010125247 | A2 | * | 11/2010 | D21H 11/18 |
| FI | WO 2011064441 | A1 | * | 6/2011 | D21H 11/18 |
| FI | EP 2425057 | B1 | * | 7/2013 | D21H 11/18 |
| FI | EP 2615207 | A1 | * | 7/2013 | D21H 11/18 |
| FI | EP 2615208 | A1 | * | 7/2013 | D21H 11/18 |
| FI | WO 2014029916 | A1 | * | 2/2014 | D21H 11/18 |
| FI | WO 2014029917 | A1 | * | 2/2014 | D21H 27/38 |
| FI | WO 2014184442 | A1 | * | 11/2014 | D21H 21/02 |
| FI | WO 2015011337 | A1 | * | 1/2015 | C08B 15/04 |
| FI | WO 2015044520 | A1 | * | 4/2015 | D21H 11/18 |
| FI | WO 2015101498 | A1 | * | 7/2015 | D21H 11/18 |
| JP | 2011074528 | A | | 4/2011 | |
| WO | 00/47628 | A2 | | 8/2000 | |
| WO | 2010/092239 | A1 | | 8/2010 | |
| WO | 2010/113922 | A1 | | 10/2010 | |
| WO | 2011/055017 | A1 | | 5/2011 | |
| WO | 2011/068457 | A1 | | 6/2011 | |
| WO | 2012/039668 | A1 | | 3/2012 | |
| WO | 2012/098296 | A2 | | 7/2012 | |

OTHER PUBLICATIONS

Schlosser, "Nano-disperse Cellulose and Nano-fibrillated Cellulose—New Products for Paper and Board Manufacture and Coating," Int. Papwirtsch, 2008, No. 9, pp. 41-44.
Search Report issued in International Application No. PCT/FI2013/050814 mailed Nov. 11, 2013.
Written Opinion of the International Searching Authority issued in Application No. PCT/FI2013/050814 mailed Nov. 11, 2013.
Office Action issued in Finnish Application No. 20125867 issued Jun. 18, 2013.
Sep. 24, 2015 Office Action issued in Chinese Patent Application No. 201380043279.5.
Mar. 30, 2016 Search Report issued in European Patent Application No. 13831064.4 (incorrectly dated as Apr. 4, 2016).

* cited by examiner

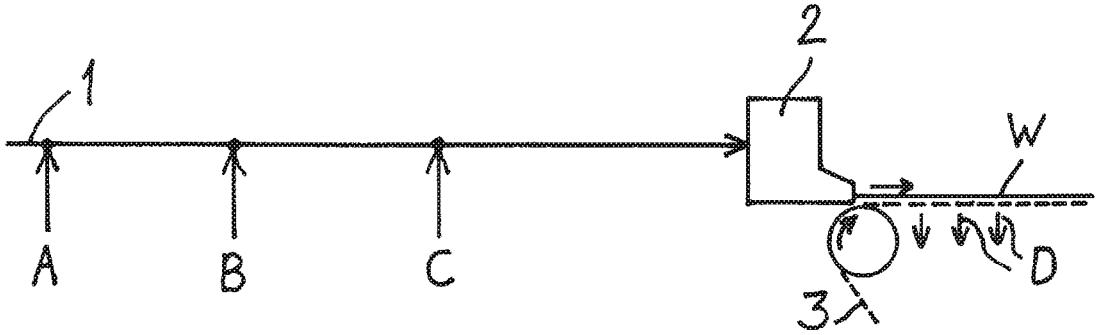
1
2
W
A
B
C
D
3

METHOD FOR MAKING PAPER PRODUCT AND PAPER PRODUCT

FIELD OF THE INVENTION

The present invention relates to a method for making a paper product starting from aqueous furnish containing fibres and filler. The invention also relates to a paper product made from the furnish and containing fibres and filler.

BACKGROUND OF THE INVENTION

It is desirable to increase the proportion of filler in paper products and thereby to reduce the use of fibres. In addition to low price and good availability, fillers also increase the printability and optical properties of paper. However, increasing the filler contents above 30 wt-% in the paper product is challenging, especially when the paper product is a low-weight paper grade. Poor retention of the filler in the paper results in increased contents of the filler in circulation waters of the papermaking process, which may cause problems in the process. Use of chemical retention aids, such as c-PAM (cationic polyacrylamide) has its upper limits too.

Another problem related to the large filler proportions is the weakening of the mechanical properties of the paper product, because the fillers interfere with the bonds between the fibres which create the structural integrity of the paper product mainly by means of hydrogen bonds between cellulose molecules. Both the poor retention of the filler and weakened mechanical properties of the paper product are due to poor fiber-filler bond in the fibrous network.

SUMMARY OF THE INVENTION

Thus, there is a need for a novel method where the filler proportion could be raised in a manner which allows the filler particles to be retained in the network of the fibres, without affecting the strength properties of the paper product too much, by increasing the affinity of the filler towards the fibrous network.

Said need is satisfied according to method where anionically charged nanofibrillar cellulose and cationic strength additive is added to the aqueous furnish. The aqueous furnish so obtained, containing the fibres, the filler, the cationic strength additive and the anionically charged nanofibrillar cellulose, is made to a paper product by dewatering the furnish. The paper product made from the furnish by dewatering has a target basis weight and contains the fibres, the filler, the cationic strength additive and the anionically charged nanofibrillar cellulose.

By adding anionically charged nanofibrillar cellulose into the furnish simultaneously with or after the addition of the cationic strength additive, an increase of the filler content in the paper product is observed. The filler can be collected form the circulation waters of the papermaking process and fixed to the paper product, which gives clearer circulation waters as result. The dosage of the filler and the anionically charged nanofibrillar cellulose can be adjusted so that filler retention is maximized, that is, minimum amount of filler end up in the circulation waters. The filler is dosed in the furnish in an amount to reach the filler content of more than 35 wt-%, preferably more than 40 wt-% on the weight of uncoated paper product.

According to one embodiment of the method, retention aid is also added to the furnish. The retention aid can be added to the furnish after the addition of the anionically charged nanofibrillar cellulose. The retention aid can be c-PAM (cationic polyacrylamide) or another retention aid.

According to one embodiment, the cationic strength additive is cationic polymer (polyelectrolyte). Cationic starch is widely used dry strength additive in papermaking and can be used according to one embodiment of the method.

The anionically charged nanofibrillar cellulose is nanofibrillar cellulose where the cellulose molecules are modified so that they contain anionic groups. The hydroxyl groups of the cellulose can be for example oxidized to carboxylate groups. One example of anionically charged nanofibrillar cellulose which can be used is nanofibrillar cellulose where the carboxylate groups are the result of catalytic N-oxyl mediated oxidation, such as 2,2,6,6-tetramethyl-1-piperidine N-oxide-mediated ("TEMPO"-mediated) oxidation of cellulose. The carboxylate groups obtained through oxidation make the cellulose also labile to such extent that the fibres can be disintegrated to fibrils with less energy. Another alternative for the anionically charged nanofibrillar cellulose is nanofibrillar cellulose where the cellulose is carboxymethylated. This fibril cellulose can also be made by chemical modification (carboxymethylation) of the fibres and subsequent disintegration of the fibres to fibrils.

According to one embodiment, the anionically charged nanofibrillar cellulose is added to the furnish in an amount of 0.1 . . . 5 wt-%, preferably 0.5 . . . 2.0 wt-% of the dry weight of uncoated paper product.

According to one embodiment, the paper product contains more than 35 wt-% filler, especially more than 40 wt-% filler on dry weight of uncoated paper. The filler amount can be for example in the range of 40 . . . 50 wt-%.

According to one embodiment, the basis weight of uncoated paper manufactured from the furnish is 30 . . . 80 $g/m^2$, preferably 40 . . . 70 $g/m^2$. Thus, the method can be used especially for low basis weight grades, where the difficulty of filler loading has been greatest. Because of the improved retention, these low-weight paper-grades can be now provided with the above-mentioned amounts of filler.

The fibre component (papermaking fibres) of the furnish forming the structural body of the paper in the form of fibrous network can be virgin pulp or recycled pulp. In the latter case, the furnish may also contain substances present in the paper or broke, of which the recycled pulp is made.

The furnish and consequently the paper product made form the furnish can also contain other additives, in addition to the materials mentioned above. These include alum, bentonite and colloidal silica.

In the method, the anionically charged nanofibrillar cellulose acts as a kind of fibrillar retention aid binding the filler to the fibrous network of the papermaking fibers, which are normal-size fibres and can be made of variety of pulps which in turn can be based on many cellulosic raw materials. The nanofibrillar cellulose is characterized by considerably smaller size compared with the papermaking fibers and by anionic charge on the surface of the fibrils due to anionic groups, especially carboxylates.

The method differs from previous technique, where the surface of the filler particles is modified with fibril cellulose, in that the nanofibrillar cellulose is now added directly to the aqueous furnish containing the fibres, cationic strength additive and the filler in mixture, and no pretreatment of the filler to increase its retention is needed.

DESCRIPTION OF THE DRAWINGS

The method and its variations and the paper product obtained will now be described in more detail with reference to the appended drawings, in which:

The FIGURE shows schematically the method for preparing a paper product

DETAILED DESCRIPTION OF THE INVENTION

In the method shown in the FIGURE, the furnish coming from the stock preparation system is denoted with arrow 1. The furnish flows in a so-called approach flow system in the short circulation of the papermaking machine after the wire pit, where it was diluted with water. Pumps and screens of the approach system are not illustrated. Fibres and fillers in the aqueous furnish can be fillers and fibres commonly used for paper and paperboard manufacture in a typical paper mill process, where the furnish is supplied to feeding device 2, which spreads the furnish evenly to a foraminous moving support 3 (forming fabric), on which the dewatering starts and the fibrous web W starts the formation. After dewatering and drying steps the result is a paper product.

Water initially removed from the web during the formation is denoted with downward arrows D. The filler content of this water D, which is circulated back to the stock preparation system, can be reduced by using the method.

The FIGURE is only a schematic representation of the initial phase of the paper manufacture. The former can have two opposite foraminous supports, between which the furnish is supplied, and the dewatering can take place in both directions (so-called twin-wire former), through both supports.

Subsequent points of addition along the approach system are shown in the FIGURE. The cationic strength additive is added to the furnish at point A, thereafter the anionic nanofibrillar cellulose is added at point B, and thereafter the retention aid is added at point C. Before the first point of addition the furnish already contains fibres and filler in adjusted proportion.

The order of addition can vary. It is also possible that the cationic strength additive and the anionic nanofibrillar cellulose are added simultaneously to the flow of the furnish, or the anionic nanofibrillar cellulose is added before the cationic strength additive. One possibility is to add the anionic nanofibrillar cellulose in portions at two different points. The first portion can be added for example before the addition of the cationic strength additive, and the second portion can be added simultaneously with or after the addition of the cationic strength additive. The retention aid is added last to the flow of the furnish Part of the cationic strength additive can be added already to the original furnish comprising the fibres and the filler, and the rest is added to the approach flow system shown in the FIGURE.

The anionic nanofibrillar cellulose is added so that It's retention time in the flow before the dewatering and paper web formation starts is relatively short. Contrary to what might be expected, the anionic nanofibrillar cellulose has best effect when it is added to the furnish when it is flowing in the approach flow system and not initially mixed with the fibres and filler, and the delay to the start of dewatering (in the FIGURE point B—support 3) is relatively short, under 1 min.

The paper product produced by the method can be paper or paperboard. The method is especially suitable for making relatively lightweight printing paper grades, such as WFC base paper and SC paper. The preferable basis weight of the printing paper grades is in the range of 30 . . . 80 g/m$^2$, preferably 40 . . . 70 g/m$^2$ uncoated paper.

Anionically charged nanofibrillar cellulose or "anionic nanofibrillar cellulose" added to the furnish increases thus the retention of the filler in the formed paper web. Nanofibrillar cellulose refers to a collection of isolated cellulose microfibrils or microfibril bundles derived from cellulose raw material. Nanofibrillar cellulose has typically a high aspect ratio: the length might exceed one micrometer while the number-average diameter is typically below 200 nm. The diameter of nanofibril bundles can also be larger but generally less than 5 μm. The smallest nanofibrils are similar to so called elementary fibrils, which are typically 2-12 nm in diameter. The dimensions of the fibrils or fibril bundles are dependent on raw material and disintegration method. The nanofibrillar cellulose may also contain some hemicelluloses; the amount is dependent on the plant source. Mechanical disintegration of nanofibrillar cellulose from cellulose raw material, cellulose pulp, or refined pulp is carried out with suitable equipment such as a refiner, grinder, homogenizer, colloider, friction grinder, ultrasound sonicator, fluidizer such as microfluidizer, macrofluidizer or fluidizer-type homogenizer.

The nanofibrillar cellulose is preferably made of plant material. One alternative is to obtain the fibrils from non-parenchymal plant material where the fibrils are obtained from secondary cell walls. One abundant source of cellulose fibrils is wood fibres. The nanofibrillated cellulose is manufactured by homogenizing wood-derived fibrous raw material, which may be chemical pulp. The disintegration in some of the above-mentioned equipments produces fibrils which have the diameter of only some nanometers, which is 50 nm at the most and gives a dispersion of fibrils in water. The fibrils can be reduced to size where the diameter of most of the fibrils is in the range of only 2-20 nm only. The fibrils originating in secondary cell walls are essentially crystalline with degree of crystallinity of at least 55%.

The nanofibrillar cellulose used is nanofibrillar cellulose containing anionically charged groups (anionically charged nanofibrillar cellulose). Such anionically charged nanofibrillar cellulose can be for example chemically modified cellulose that contains carboxyl groups as a result of the modification.

Cellulose obtained through N-oxyl mediated catalytic oxidation (e.g. through 2,2,6,6-tetramethyl-1-piperidine N-oxide, "TEMPO") or carboxymethylated cellulose are examples of anionically charged nanofibrillar cellulose where the anionic charge is due to a dissociated carboxylic acid moiety. Anionically charged nanofibrillar cellulose is typically produced by modifying pulp chemically, whereafter the fibres of the pulp are disintegrated to nanofibrillar cellulose.

The filler can be any filler used in paper manufacturing, e.g. precipitated calcium carbonate (PCC), ground calcium carbonate (GCC), kaolin clay, talc or gypsum.

In the method, the filler is added to the furnish to reach a high filler content in the paper product, which is possible due to the enhanced retention. The filler is added in an amount which results in the final filler content of more than 35 wt-%, especially more than 40 wt-% on the uncoated weight of the paper product. The filler contents of 50 wt-% can be easily reached by the method. The filler content may be for example in the range of 40 . . . 50 wt-% of the uncoated weight of the paper, which is more than has been possible before, especially with relatively lightweight printing paper grades. The anionic nanofibrillar cellulose is added to the furnish in an amount of 0.1 . . . 5 wt-%, preferably 0.5 . . . 2.0 wt-% on the dry weight of the uncoated paper.

The cationic strength additive is a strongly cationic polymer (polyelectrolyte), and it can be any dry strength additive used in paper manufacturing, such as cationic starch or cationic polyvinylamine. Preferably, the cationic polyelectrolyte is cationic starch (CS). The cationic strength additive is added in an amount of 0.1 . . . 2.5 wt-%, preferably 0.5 . . . 1.0 wt-% of dry weight of uncoated paper.

The retention aid is also a cationic polymer (polyelectrolyte), and it can be any retention aid used in paper manufacturing used to improve the retention of fillers and fines in the paper. It can be cationic polyacrylamide (CPAM), polydimethyldiallyl ammonium chloride (PDADMAC), or polyethylene-imine (PEI). Also, the combinations of these different polyelectrolytes can be used.

The following examples were carried out to illustrate the method. The examples are not intended to limit the scope of the invention.

Pilot Tests

Paper reels of WFC base paper and wood-containing printing paper were pulpered and used as a furnish for pilot paper machine. The basis weight of the paper made was set to 50 . . . 80 g/m$^2$. Fresh filler was added to the machine stock batchwise. In reference situation furnish was run as such with only c-PAM used as retention aid. In next steps cationic starch or cationic polyvinylamine were dosed to machine furnish before c-PAM dosage. c-PAM dosage was kept constant. Filler amount in paper remained practically constant but wire pit filler content increased as a high amount of filler had to be dosed to the system to achieve the targeted filler content level in paper.

Next step was to add anionic nanofibrillar cellulose (anionically charged nanofibrillar cellulose made by oxidation) after cationic starch or cationic polyvinylamine, but before c-PAM. A significant improvement in filler retention was observed and filler content in paper rose by about 10%-units or more. In these tests, filler contents as high as 50% could be reached.

The invention claimed is:

1. A method for making a paper product starting from aqueous furnish containing fibres and filler, the method comprising:

adding cationic strength additive to the aqueous furnish;

adding anionically charged nanofibrillar cellulose to an approach flow where the furnish is flowing towards dewatering; and making the furnish into a paper product by dewatering the furnish, wherein the anionically charged nanofibrillar cellulose is added to the approach flow at a point where a residence time is less than 1 minute before a start of the dewatering.

2. The method according to claim 1, wherein cationic retention aid is also added to the furnish.

3. The method according to claim 2, wherein the cationic strength additive is also added to the approach flow where the furnish is flowing towards the dewatering.

4. The method according to claim 3, wherein the cationic strength additive is added to the approach flow prior to or simultaneously with the addition of the anionically charged nanofibrillar cellulose.

5. The method according to claim 4, wherein the anionically charged nanofibrillar cellulose is added to the furnish in an amount of 0.1-5 wt-% calculated on the dry weight of uncoated paper.

6. The method according to claim 2, wherein the cationic retention aid is added to the approach flow after the addition of the anionically charged nanofibrillar cellulose and after the addition of the cationic strength additive.

7. The method according to claim 1, wherein the cationic strength additive is also added to the approach flow where the furnish is flowing towards the dewatering.

8. The method according to claim 7, wherein the cationic strength additive is added to the approach flow prior to or simultaneously with the addition of the anionically charged nanofibrillar cellulose.

9. The method according to claim 8, wherein the anionically charged nanofibrillar cellulose is added to the furnish in an amount of 0.1-5 wt-% calculated on the dry weight of uncoated paper.

10. The method according to claim 1, wherein the cationic strength additive is cationic polymer.

11. The method according to claim 10, wherein the cationic strength additive is cationic starch.

12. The method according to claim 1, wherein the anionically charged nanofibrillar cellulose is nanofibrillar cellulose where the hydroxyl groups of the cellulose are oxidized to carboxylate groups or nanofibrillar cellulose where the cellulose is carboxymethylated.

13. The method according to claim 1, wherein the anionically charged nanofibrillar cellulose is added to the furnish in an amount of 0.1-5 wt-% calculated on the dry weight of uncoated paper.

14. The method according to claim 1, wherein the anionically charged nanofibrillar cellulose is added to the furnish in an amount of 0.5-2.0 wt-% calculated on the dry weight of uncoated paper.

15. The method according to claim 1, wherein a basis weight of the paper product made is 30-80 g/m$^2$ of uncoated paper.

16. The method according to claim 15, wherein the basis weight of the paper product made is 40-70 g/m$^2$ of uncoated paper.

17. The method according to claim 1, wherein the filler is precipitated calcium carbonate, ground calcium carbonate, clay, talc or gypsum.

18. The method of claim 1, wherein the filler includes unmodified filler particles.

19. The method of claim 1, wherein the content of the filler in the paper product is at least 35 wt %.

20. The method of claim 1, wherein the content of the filler in the paper product is from about 40 wt % to about 50 wt %.

* * * * *